US006328135B1

(12) United States Patent
Sirag, Jr. et al.

(10) Patent No.: US 6,328,135 B1
(45) Date of Patent: Dec. 11, 2001

(54) MODIFYING ELEVATOR GROUP BEHAVIOR UTILIZING COMPLEXITY THEORY

(75) Inventors: David J. Sirag, Jr., Ellington; George S. Copeland, Wethersfield, both of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/694,238

(22) Filed: Oct. 23, 2000

(51) Int. Cl.[7] ..... B66B 1/18
(52) U.S. Cl. ..... 187/382; 187/386; 187/387
(58) Field of Search ..... 187/380, 382, 187/384, 386, 387

(56) References Cited

U.S. PATENT DOCUMENTS 4,473,134 * 9/1984 Uetani ..... 187/382
5,260,526 * 11/1993 Sirag ..... 187/387
5,260,527 * 11/1993 Sirag ..... 187/392
5,338,904 * 8/1994 Powell et al. ..... 187/387
5,668,356 * 9/1997 Powell et al. ..... 187/382
5,672,853 * 9/1997 Whitehall et al. ..... 187/380
5,808,247 * 9/1998 Thangavelu ..... 187/386

* cited by examiner

*Primary Examiner*—Jonathan Salata

(57) ABSTRACT

The position and direction (0–27, FIG. 2) of each elevator car (A–D) in a group of cars is recorded along with time and traffic rate of the elevator group to provide a data stream. The canonic representation of the position and direction data is reduced, to eliminate symmetry (FIGS. 1, 3 and 4) resulting from the relative positions and directions of the cars being the same except for the identification of which car is at which position and direction. An entropy estimation algorithm is used to provide a plot of entropy as a function of time, which is then translated from the other data in the stream to entropy as a function of traffic rate (FIG. 5). A maximum traffic rate is chosen, and thereafter, during normal operation, if the current rate is higher than the maximum, an elevator group parameter is altered to increase the traffic-handling capability of the group, but if the current traffic rate is lower than the maximum, an elevator parameter is altered in a manner to decrease the traffic-handling capability of the group.

4 Claims, 5 Drawing Sheets

| FIG.3 Y / FIG.1 X | A=0 | B=15 | C=17 | D=4 |
|---|---|---|---|---|
| A=15 | 13 | 0 | 2 | 17 |
| B=17 | 11 | 24 | 0 | 15 |
| C=4 | 24 | 11 | 13 | 0 |
| D=0 | 0 | 15 | 17 | 4 |

| | A | B | C | D |
|---|---|---|---|---|
| A | 11 | 24 | 15 | 0 |
| B | 13 | 0 | 17 | 2 |
| C | 0 | 13 | 4 | 17 |
| D | 24 | 9 | 0 | 13 |

FIG. 6 D MAPS TO A

| FIG.3 Y / FIG.1 X | A=0 | B=15 | C=17 | D=4 |
|---|---|---|---|---|
| A=15 | ~~13~~ | 0 | 2 | 17 |
| B=17 | ~~11~~ | 24 | 0 | 15 |
| C=4 | ~~24~~ | 11 | 13 | 0 |
| D=0 | ~~0~~ | ~~15~~ | ~~17~~ | ~~4~~ |

| | B | C | D |
|---|---|---|---|
| A | 24 | 11 | 0 |
| B | 0 | 13 | 2 |
| C | 13 | 0 | 17 |

FIG. 7 A MAPS TO B

| FIG.3 Y / FIG.1 X | A=0 | B=15 | C=17 | D=4 |
|---|---|---|---|---|
| A=15 | ~~13~~ | ~~0~~ | ~~2~~ | ~~17~~ |
| B=17 | ~~11~~ | ~~24~~ | 0 | 15 |
| C=4 | ~~24~~ | ~~11~~ | 13 | 0 |
| D=0 | ~~0~~ | ~~15~~ | ~~17~~ | ~~4~~ |

| | C | D |
|---|---|---|
| B | 13 | 0 |
| C | 0 | 15 |

FIG. 8 C MAPS TO D ; B MAPS TO C

| FIG.9 Y / X FIG.1 | A=20 | B=16 | C=24 | D=6 |
|---|---|---|---|---|
| A=15 | 5 | 1 | 9 | 19 |
| B=17 | 3 | 27 | 7 | 17 |
| C=4 | 16 | 12 | 20 | 2 |
| D=0 | 20 | 16 | 24 | 6 |

| | A | B | C | D |
|---|---|---|---|---|
| A | 15 | 26 | 15 | 0 |
| B | 17 | 0 | 17 | 2 |
| C | 4 | 15 | 4 | 17 |
| D | 0 | 11 | 0 | 13 |

FIG. 10 A MAPS TO B

| FIG.9 Y / X FIG.1 | A=20 | B=16 | C=24 | D=6 |
|---|---|---|---|---|
| A=15 | 5 | 1 | 9 | 19 |
| B=17 | 3 | 27 | 7 | 17 |
| C=4 | 16 | 12 | 20 | 2 |
| D=0 | 20 | 16 | 24 | 6 |

| | A | C | D |
|---|---|---|---|
| B | 17 | 17 | 0 |
| C | 4 | 4 | 15 |
| D | 0 | 0 | 11 |

FIG. 11 B MAPS TO A

| FIG.9 Y / X FIG.1 | A=20 | B=16 | C=24 | D=6 |
|---|---|---|---|---|
| A=15 | 5 | 1 | 9 | 19 |
| B=17 | 3 | 27 | 7 | 17 |
| C=4 | 16 | 12 | 20 | 2 |
| D=0 | 20 | 16 | 24 | 6 |

| | C | D |
|---|---|---|
| C | 4 | 4 |
| D | 0 | 0 |

FIG. 12 C MAPS TO C ; D MAPS TO D

MODIFYING ELEVATOR GROUP BEHAVIOR UTILIZING COMPLEXITY THEORY

TECHNICAL FIELD

This invention relates to operation of a group of elevators in which elevator operational parameters are adjusted in a manner to tend to increase the entropy of the system, thereby to reduce elevator car bunching.

BACKGROUND ART

Very sophisticated elevator dispatching systems have been employed to assign hall calls to elevator cars of a group in such a manner as to minimize waiting for service by intended passengers as well as to minimize impact on service to passengers already on board. Elevator systems, however, have a characteristic called "bunching" when all or most of the elevators seem to be positioned in close proximity to one another, that is, clustered about some level of the building. It is known that despite the considerable capability of the dispatchers, passenger service suffers whenever bunching occurs. To overcome this problem, there have been many attempts to provide specific algorithmic modifications to the system as a consequence of tendencies for elevator cars to become bunched, changing car assignments that have been made by the sophisticated dispatcher based on the additional information provided by the bunching algorithm. However, to the extent that information is available, it is believed clear that no algorithm designed to mitigate bunching has improved elevator service, and in fact most have caused elevator service to deteriorate still further.

DISCLOSURE OF INVENTION

Objects of the invention include reducing bunching of elevator cars in a group without altering dispatcher call assignments; reducing bunching of elevator cars in a group without causing deterioration of passenger service; and improved passenger service in an elevator group using a sophisticated dispatcher, by mitigating bunching.

This invention is predicated on the concept that small changes in some operating parameters of elevators in a group having high entropy (highly complex) operation may cause large differences in the behavior of the elevator group. This invention is also predicated on the discovery that bunching of elevator cars in a group is minimized when elevator system operation exhibits high entropy. This invention is further predicated on the discovery that moderate traffic is the most complex while very light and very heavy traffic exhibit less complexity. This invention is additionally predicated on the discovery that raw elevator car position/direction data has, in any practical sense, no pattern repetition, but reduction of the canonical representation of the data (to eliminate pattern differences which are due only to the labeling of the elevator cars) provides pattern repetition, the similarity distance of which can be measured by known algorithms, including Lyapunov exponent algorithms and entropy estimation algorithms.

According to the present invention, complexity of elevator group behavior as a function of traffic rate is first determined over a period of time to find a threshold traffic rate having maximum complexity, then, during operation, system operational parameters are adjusted as a function of traffic rate, which have an effect of adjusting the effective traffic rate toward the traffic rate of maximum complexity, in order to ensure frequently occurring periods with high system complexity, and consequentially, low bunching.

These adjustments may include reducing or increasing door dwell time, reducing or increasing maximum acceleration or velocity, changing the fraction of time in which a swing car, such as a VIP car or a combined passenger/freight elevator carries regular passenger traffic, or the time a swing car spends in one or another group. Increasing the time required for the elevator group to respond to traffic when traffic rate is below the threshold provides a result similar to an increase in traffic rate thereby increasing the complexity of group behavior, and may be considered to be an increase in effective traffic rate, and vice versa.

Attempts to deal with bunching in the prior art deal with a single car, or a pair of cars, such as by changing a hall call assignment. In contrast, the present invention will apply small perturbations to the entire elevator group, which will be basically invisible to the dispatching scheme, while tending to increase complexity, and thereby reduce bunching. The perturbations themselves increase complexity, since it is inherent that the behavior of a system having variations in its parameters is more complex than the behavior of a system with invariant parameters. In addition, since the perturbations are oriented in a manner which tends to naturally increase the effective complexity, there is a tendency to assure periods of complex behavior which will reduce bunching.

Other objects, features and advantages of the present invention will become more apparent in the light of the following detailed description of exemplary embodiments thereof, as illustrated in the accompanying drawing.

BRIEF DESCRIPTION OF THE DRAWINGS

FIGS. 6–8 are diagrams of one form of canonical reduction of the positions and directions of FIGS. 1 and 3.

FIGS. 10–12 are diagrams of canonical reduction of FIGS. 1 and 9.

MODE(S) FOR CARRYING OUT THE INVENTION

The determination of the relationship between system complexity (entropy) and traffic rate is accomplished over a period of time, only once, or periodically (such as once a month or so) across the life of the elevator. After the threshold traffic rate has been determined, off-line, as described hereinafter, then during normal operation on a regularly recurring basis, such as every 200 milliseconds or so, the elevator system controller (such as the group controller, or other controller) will determine the current traffic rate, compare it with the established threshold value (such as 3.5 or 4.5 as described hereinafter in the example of FIG. 5) and adjust system operation by either adding or removing a swing car, increasing or decreasing maximum car acceleration, increasing or decreasing car rated speed, increasing or decreasing door dwell time, and other operational adjustments which can affect the effective traffic rate, that is, the traffic vs. traffic handling capability of the system. During some period (or series of non-contiguous periods) of normal operation of the elevator group, which may be between one and three months, or more, as desired, the elevator system configuration, represented by the car station numbers (position/direction information) are logged, along with a time stamp and traffic rate. Traffic rate is recorded as the number of passengers occupying the elevator system in each five minute period, expressed as a percent of the building population, as is conventional.

In order to present the behavioral complexity of an elevator system, a complexity estimator (i.e., an estimator of entropy) is employed. Typically, to apply the complexity estimator to the data stream, we must have a "similarity distance" metric, a function which indicates how similar any two data elements (configurations) are. By definition, any two identical data elements will have a similarity distance of zero with regard to this metric. A vector that contains encoded elevator data (position and direction) at a given point in time, called the building configuration vector, has one component for each elevator in the building. In this application, the configuration similarity distance metric must measure the distance between any two such building configuration vectors.

Typical measures of distances between vectors, known to those skilled in the art, normally involve such calculations as component differencing followed by some function applied to the collection of differences. One such measure takes the square root of the sum of the squares of the differences (the L2 norm). All widely known methods for measuring distances between vectors miss two points which are important in elevator behavior.

The component differencing function must capture the physical and behavioral characteristics of the elevator system. Conceptually, the distance between two car positions must be computed around a circle where all travel may occur in only one direction, e.g., clockwise.

Figure 2:
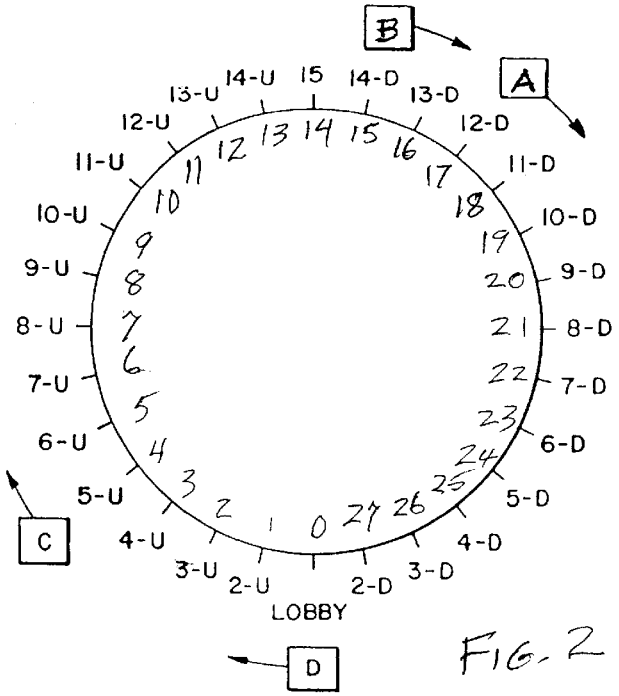
FIG. 2 is a schematic illustration of a circular model of the floors in a building, the up and down directions of car travel, and numbering of the stations on the circle representing car position and travel direction.
Figure 1:
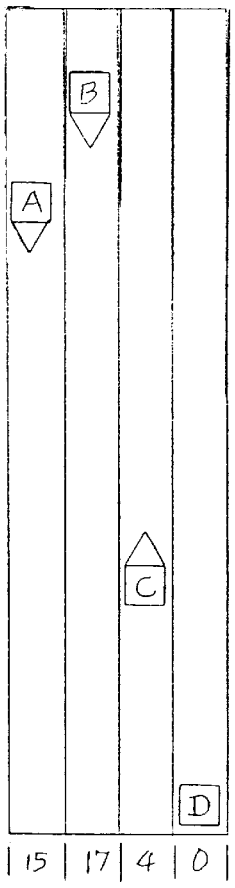
FIG. 1 is a schematic representation of elevator positions and movement.

FIG. 1 is a simplified schematic illustration of elevator cars moving in a building. Each car is identified by a letter within it, and the direction each car is traveling is indicated by an arrow above the car (up) or below the car (down). Referring to FIG. 2, a building's floors are represented on a circle, on which the cars travel in a clockwise direction. Up and down are indicated by "U" and "D" after the floor number. According to the invention, each station on the circle, representing a car position and direction, is set forth inside the circle.

For example, the distance from a car at the lobby to a car at floor-1-up should be small but the distance from a car at floor-1-up to a car at the lobby should be large since this captures the typical behavioral constrains on an elevator system. This function is the "positional distance". The positional distance chosen for this application uses car position and direction of motion encoded as a single number on a circuit around the building (Lobby=0, Floor-1-up=1, Floor-2-up=2, . . . , Penultimate-Floor-up=N−2, Top Floor=N−1, Penultimate-Floor-down=N, . . . , Floor 1 down=2N−3). Using this representation the positional distance function must also account for the "numbering discontinuity" between Floor-1-down and the Lobby. The positional distance computation from X to Y can be presented as "IF X>Y, THEN (2N−2)−(X−Y); ELSE Y−X". In general, other positional distance functions could be used to define physical or behavioral properties of the system, if desired.

Second, the permutation (i.e., rearrangement) of vector components should have no effect on the distances between vectors.

Figure 3:
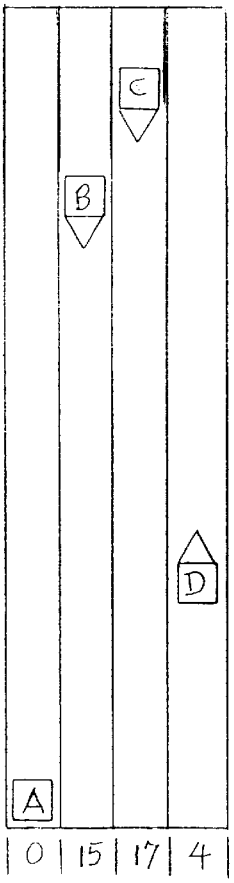
FIGS. 3 and 4 are schematic representations of elevator positions and movement which, while each elevator is in a position different from its position in FIG. 1, the overall configuration is canonically identical to that of FIG. 1 (when car identity is ignored).
Figure 4:
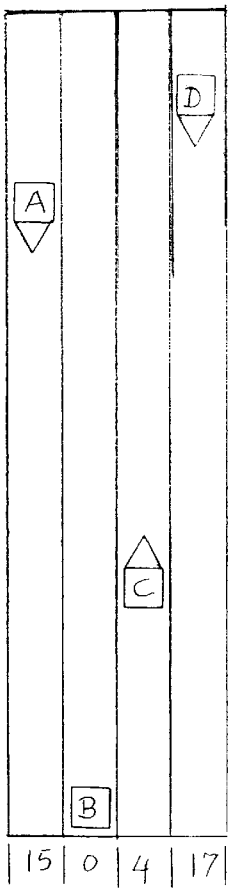

According to the invention, it has been found that the elevator stations (e.g., 15, 17, 4 and 0 in FIGS. 1 and 2) will, generally speaking, not repeat within any meaningful time period (weeks or months). Commonly used mathematical metrics for measuring the similarity distance between similar elevator vectors (e.g., FIG. 1 and FIG. 3) will always generate a non-zero similarity distance. Without canonical reduction, the chance of seeing a repeating pattern in a system having floors and cars equals $C^F$. In the example in the figures, this would be $4^{20}$ which is a very large number. However, following canonical reduction, the chances are $C^F$/Cl; in this example 4!=24, so the chances are 24 times greater that a pattern repetition will occur following canonical reduction. It has been discovered that the particular elevator at a particular station is irrelevant. Thus, when the elevators have the stations indicated in FIG. 3 (e.g., 0, 15, 17, 4) the system state can be treated as being identical to that of FIG. 1. In FIG. 3, it is as if the role of the elevators was simply retarded by one elevator: that is, that elevator A took the position of elevator D, elevator B took the position of elevator A, and so forth. However, it is equally true that stations that are not simply skewed by one elevator may be canonically identical insofar as bunching information is concerned. According to the invention, it is found that after eliminating symmetry by reducing the canonical representation of the data, as is illustrated with respect to FIGS. 1, 3 and 4, the data does have a repetitive pattern, and the similarity distance between elements of the data stream has sufficient information to estimate the entropy of elevator behavior in operation. Thus, the stations, 15, 0, 4 and 17 illustrated in FIG. 4 have the same meaning in the invention as the stations of FIG. 1 or FIG. 3. In a very simple embodiment, a first step in processing the data is to achieve reduction of canonical representation by simply aligning the stations from highest to lowest (or it could be from lowest to highest if desired). Thus, for all of the configurations of FIGS. 1, 3 and 4, if the stations are aligned top down, then each of them will have the station order 17, 15, 4 and 0. In the invention, the datum which is a configuration distance metric of the two building configurations shown in FIGS. 1 and 3, is the summation of the positional distances of the mapped pairs: i.e., car A, FIG. 1 to car B, FIG. 3, =zero; car B, FIG. 1 to car C, FIG. 3, =zero; car C, FIG. 1 to car D, FIG. 3=zero; and car D, FIG. 1 to car A, FIG. 3=zero. The configuration distance metric is the summation of the four positional distances; the metric for this datum (FIG. 1/FIG. 3) is zero. The data stream includes a configuration distance metric for each system configuration in the raw data with respect to each other system configuration in the raw data.

A standard entropy calculation or estimation algorithm may be applied to the time sequence of configuration distance metrics, so as to provide a plot of entropy as a function of time, which can then be translated into entropy as a function of traffic rate. One such application is Wyner's sliding window entropy estimation technique, based on the Asymptotic Equipartition Property Theorem of Shannon and McMillan. This is described in Wyner, A. D., "Typical Sequences and All That: Entropy, Pattern Matching, and Data Compression", Proceedings of 1994 IEEE International Conference on Information Theory, Trendheim, Norway, June 27–Jul. 1, 1994. The Wyner algorithm uses the sequence, $\{X_k\}$, of configuration distance metrics as one input and a similarity distance function, $f_c$, as another input to produce a single number, H, which describes the information complexity of the data sequence for each point in time, using one dimension per car in the group. The result of the entropy estimation technique is a series of entropy values as a function of time.

Figure 5:
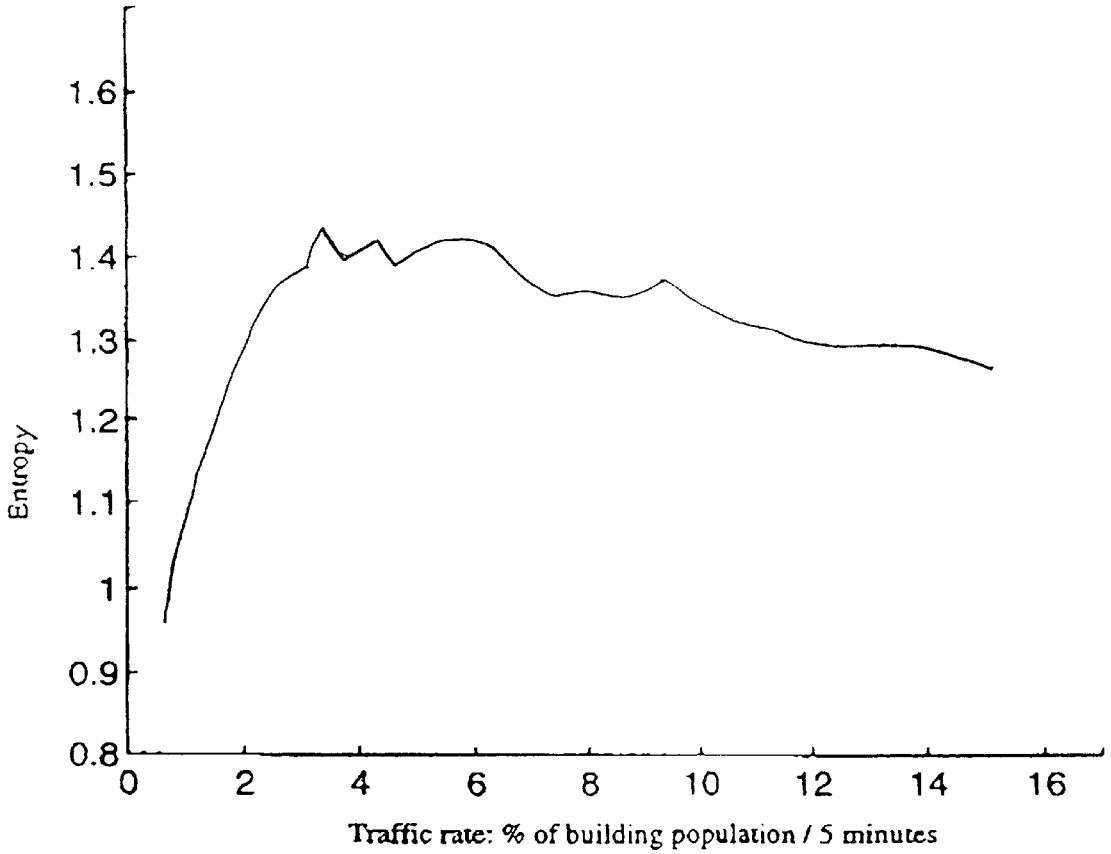
FIG. 5 is a plot of entropy as a function of elevator traffic rate.

By sorting these values out in accordance with the corresponding, time-related traffic rates, the relationship between entropy and traffic rate, such as that shown in FIG. 5 can be obtained. For a particular elevator system, the processing of elevator car position/direction information as described hereinbefore identifies how the complexity (entropy) of the system varies with traffic rate (FIG. 5). From the data expressed in FIG. 5 for that particular elevator system, a point of maximum complexity such as 1.44 may identify a corresponding traffic rate of about 3.5% to be used as a threshold value for adjustments to be made in system response. That is, whenever the traffic rate of the system is measured as being below about 3.5%, then steps will be taken to cause the system to respond as if there is a higher traffic rate, by reducing system capacity or slowing the system down in some fashion, as described more fully hereinafter. On the other hand, whenever traffic rate is measured as being above about 3.5%, then adjustments will be made to the system which have the effect of causing the system to react as if there were a lower rate of traffic, such as increasing capacity or increasing the speed of response of the system in any suitable fashion as described hereinafter.

If desired, a mean maximal entropy, such as about 1.40, may be selected and seen to exist between traffic rates of about 3% to traffic rates of about 6% and the mean of those traffic rates, 4.5% may be utilized as the threshold to determine system adjustments as described hereinbefore.

As described with respect to FIGS. 1–4 hereinbefore, when acquiring the data necessary to determine the relationship between complexity and traffic rate, one way of reducing canonical representation is simply to list the station information in each instance from high station to low station (or low to high) without regard to which car is at which of the stations. In such a case, car A of FIG. 1 maps to car B of FIG. 3; car B maps to car C; car C maps to car D; and car D maps to car A. The positional distance (X to Y) between each pair of mapped cars is zero, so the configuration distance metric for FIG. 1/FIG. 3 is zero, and the input to the complexity estimation algorithm for this datum is zero.

However, this simple method does not recognize nearly-identical patterns, and it presents difficulty at the discontinuity between the highest station (28, FIG. 5) and the lowest station (0, FIG. 5). Another way in which canonical reduction may be achieved to provide measures of position distance for any configurations is illustrated in FIGS. 6–12. Referring to FIG. 6, the stations of elevator car positions and directions in FIG. 1 are set forth in the rows, and the stations of elevator car positions and directions of the configuration of FIG. 3 are set forth as columns, with the position distances between each car of FIG. 1 and each car of FIG. 2 at the row/column intersections. Thus, the positional distance between car A of FIG. 1 and car A of FIG. 3 is 13. The positional distance of car C in FIG. 1 and car B of FIG. 3 is 11, and so forth. The algorithm in this example subtracts each number in a column from the highest number in that column, although the algorithm will work equally as well subtracting every number in the row from the highest number in that row. To the right in FIG. 6 is shown the result of subtracting every number in each column from the highest number of that column. Thus, in the column under car A of FIG. 3, 24−13=11, 24−11=13, 24−24=0, and 24−0=24. Then, the column and row of the highest resulting number is chosen to map a car of one configuration (FIG. 1) to a car of another configuration (FIG. 3). In FIG. 6, the highest number, 24, appears twice, and either one may be chosen without altering the result of the algorithm. In this example, ties are broken by selecting the leftmost column, and then the highest row in the column. Thus, in FIG. 6, car D of FIG. 1 maps to car A of FIG. 3. In the next step of the algorithm, the column and row of the selected highest number (column A of FIG. 3 and row D of FIG. 1) are eliminated from the matrix of positional distances, and the subtraction in the columns of the remaining matrix is performed as illustrated in FIG. 7. Thus, in column B, 24−0=24, 24−24=0, 24−11=13, and so forth. In this instance, 24 is the highest number so car A of FIG. 1 maps to car B of FIG. 3. Then as seen in FIG. 8, row A and column B are eliminated from the matrix and the subtraction is performed on the remaining matrix. In column C, 13−0=13 and 13−13=0, and so forth. Thus, car C of FIG. 1 maps to car D of FIG. 3. Since there are only two cars left, they map to each other, and therefore car B automatically maps to car C. This completes the canonical reduction portion of the algorithm. To determine the configuration distance metric between the configuration of FIG. 1 and the configuration of FIG. 3, the positional distance of each of the mapped car pairs is summed with the positional distance of the remaining mapped car pairs as follows: the distance between car D and car A is zero; the distance between car A and car B is zero; the distance between car C and car D is zero; and the distance between car B and car C is zero; the summation of these distances is zero, and the configuration distance metric for this pair of configurations (this datum in the dat stream) is zero. This result must follow since the configurations of FIGS. 1 and 3 are canonically identical.

Figure 9:
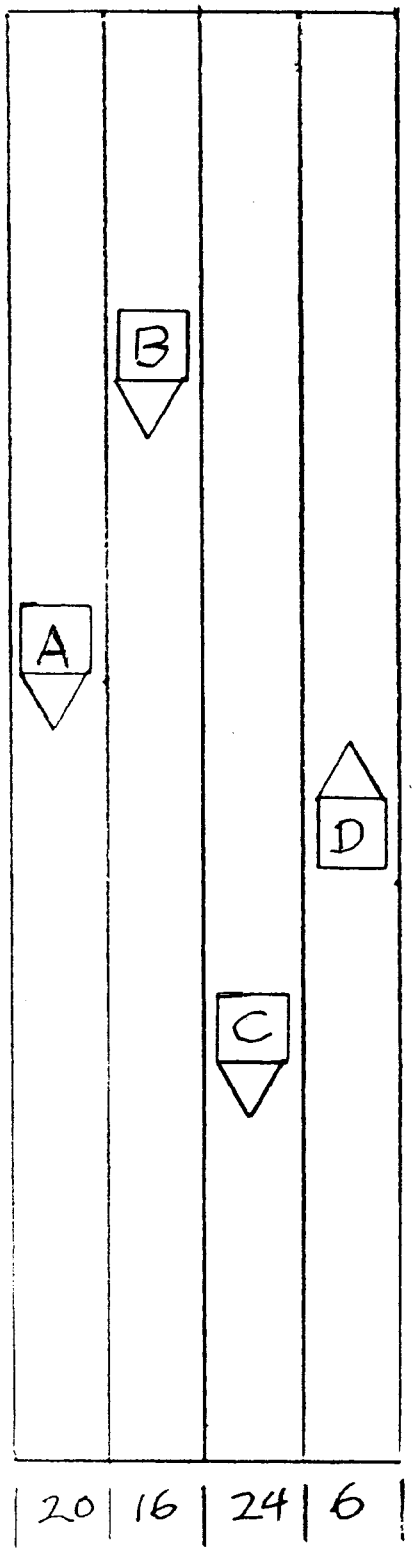
FIG. 9 is a schematic representation of additional elevator positions and movement.

Another example of the algorithm is illustrated for the case of the configuration of FIG. 1 and the configuration of FIG. 9 which is clearly distinct from the configuration of FIG. 1. In FIG. 10, each row relates to stations of the cars of FIG. 1 (similar to FIG. 6), whereas the columns relate to stations of the cars in the configuration of FIG. 9. The positional differences between the cars of FIG. 1 and the cars of FIG. 9 are set forth according to the formula provided hereinbefore. Then the subtraction of each value in a column from the largest value in that column is made, resulting in the matrix to the right in FIG. 10. Thus, under column B, 27−1=26, 27−27=0, 27−12=15, and 27−16=11, and so forth for the other columns. In this instance, 26 is the largest number so car A of FIG. 1 maps to car B of FIG. 9. In FIG. 11, row A and column B are eliminated, and the columnar subtraction is performed for the remaining nine-element matrix. To the right in FIG. 11, for instance, 20−3=17, 20−16=4, 20−20=0, and so forth for the other columns. The largest number in this instance is 17, and the leftmost column is chosen so that car B maps to car A. In FIG. 12, column A and row B are eliminated leaving a four element matrix, to which the columnar subtraction is performed. Thus, to the right in FIG. 12, 24−20=4 and 24−24=0; 6−2=4 and 6−2=0. Choosing the 4 in the leftmost column, car C maps to car C; by default car D of FIG. 1 will map to car D of FIG. 9. The positional distance between car A and car B is one; between car B and car A is three; between car C and car C is 20; and between car D and car D is six. The summation is 30, which becomes the configuration distance metric for this datum (this pair of configurations).

When each configuration in the raw data stream has had a configuration distance metric provided for it with respect to each other configuration in the raw data stream, the aforementioned entropy estimation algorithm may be run with the configuration distance metrics as the elements $\{X_k\}$, with the similarity distance function, $f_c$, to result in the complexity value or $\{X_k\}$ entropy H as a function of each datum in the data stream $\{X_k\}$.

U.S. Pat. No. 5,447,212 is incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of operating a group of elevators which is characterized by:

preliminarily, over a period of time (a) determining an elevator group threshold traffic rate at which said elevator group has a maximum value of complexity;

thereafter, during normal operation, on a regularly recurring basis (b) determining current traffic rate of said elevator group;

(c) comparing said current traffic rate to said threshold traffic rate and (a) if said current traffic rate is higher than said threshold traffic rate, altering a parameter of said elevator group in a manner which tends to increase the traffic-handling capability of said elevator group thus reducing the effective traffic rate of said elevator group, but (b) if said current traffic rate is lower than said threshold traffic rate, altering a parameter of said elevator group in a manner which tends to decrease the traffic-handling capability of said elevator group thus increasing the effective traffic rate of said elevator group.

2. A method according to claim 1 wherein said step (a) comprises:

recording as a function of time the position and direction of each car in the building and traffic rate of the building, repetitively, over a period of time, to provide a data stream of positions and directions correlated with traffic rate and time;

reducing the canonical representation of the positions and directions in the data stream;

using an entropy estimation algorithm to provide a plot of entropy against time; and converting the plot of entropy against time to a plot of entropy versus traffic rate.

3. A method according to claim 1 wherein altering a parameter of said elevator group in a manner which tends to increase the traffic-handling capability of said elevator group is selected from reducing door dwell time, increasing maximum acceleration, increasing maximum velocity, and increasing the fraction of time in which a swing car carries regular passenger traffic in the group.

4. A method according to claim 1 wherein altering a parameter of said elevator group in a manner which tends to decrease the traffic-handling capability of said elevator group is selected from increasing door dwell time, reducing maximum acceleration, reducing maximum velocity, and decreasing the fraction of time in which a swing car services the group.

* * * * *